US008396379B2

(12) United States Patent
Tsukijima

(10) Patent No.: US 8,396,379 B2
(45) Date of Patent: Mar. 12, 2013

(54) IMAGE FORMING APPARATUS FOR CONTROLLING UNLOCKING OF A TONER CARTRIDGE REPLACING DOOR

(75) Inventor: Hisashi Tsukijima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 341 days.

(21) Appl. No.: 12/763,606

(22) Filed: Apr. 20, 2010

(65) Prior Publication Data

US 2010/0272452 A1 Oct. 28, 2010

(30) Foreign Application Priority Data

Apr. 23, 2009 (JP) ..... 2009-105357

(51) Int. Cl.
*G03G 15/08* (2006.01)

(52) U.S. Cl. ..... 399/27; 399/28; 399/262

(58) Field of Classification Search ..... 399/27, 399/28, 262
See application file for complete search history.

(56) References Cited

U.S. PATENT DOCUMENTS

| | | | | |
|---|---|---|---|---|
| 6,560,416 | B2 | 5/2003 | Fischer | |
| 7,061,391 | B2 * | 6/2006 | Hopper et al. | 399/27 |
| 2002/0094210 | A1 * | 7/2002 | Fischer | 399/27 |
| 2007/0223947 | A1 * | 9/2007 | Ohkawa et al. | 399/27 |

FOREIGN PATENT DOCUMENTS

| | | | |
|---|---|---|---|
| JP | 3-50568 | A | 3/1991 |
| JP | 05-045996 | A | 2/1993 |
| JP | 11-212348 | A | 8/1999 |
| JP | 2003-345191 | A | 12/2003 |

* cited by examiner

*Primary Examiner* — David Gray
*Assistant Examiner* — Laura Roth
(74) *Attorney, Agent, or Firm* — Canon USA, Inc., IP Division

(57) ABSTRACT

A toner cartridge inserting and removing door is provided at a removal port of each of a plurality of toner cartridges. Normally, the toner cartridge inserting and removing door is locked and cannot be opened. For a case where the remaining amount of a toner in the toner cartridge is decreased and a change is needed, a display unit for notifying thereof is provided, thereby selectively opening the toner cartridge inserting and removing door corresponding to a toner cartridge for which a change is necessary.

5 Claims, 9 Drawing Sheets

FIG. 6A

SELECT TONER TO BE CHANGED AND PRESS BUTTON BELOW

| SELECT | TONER | STATE | NEED FOR CHANGE |
|---|---|---|---|
| | BLACK TONER | GOOD | NO |
| | YELLOW TONER | GOOD | NO |
| ✓ | MAGENTA TONER | ABSENT | YES |
| | CYAN TONER | ABOUT HALF | NO |

REMOVE TONER

101a

FIG. 6B

TONER UNNECESSARY FOR CHANGE IS SELECTED.
IS TONER TO BE CHANGED AS IT IS?

YES

NO

FIG. 7A

101b

SELECT TONER TO BE CHANGED AND PRESS BUTTON BELOW

▼NEED CHANGE

| SELECT | TONER | STATE | NEED FOR CHANGE |
|---|---|---|---|
| ✓ | MAGENTA TONER | ABSENT | YES |
| | | | |
| | | | |
| | | | |

REMOVE TONER

101a

FIG. 7B

101b

SELECT TONER TO BE CHANGED AND PRESS BUTTON BELOW

▼NEED CHANGE

| SELECT | TONER | STATE | NEED FOR CHANGE |
|---|---|---|---|
| | BLACK TONER | GOOD | NO |
| | YELLOW TONER | GOOD | NO |
| | CYAN TONER | ABOUT HALF | NO |
| | | | |

REMOVE TONER

101a

IMAGE FORMING APPARATUS FOR CONTROLLING UNLOCKING OF A TONER CARTRIDGE REPLACING DOOR

BACKGROUND OF THE INVENTION

1. Field of the Invention

The present invention relates to a toner supply device in which a toner cartridge is detachably provided to be used in an image forming apparatus such as a printer, a copying machine, and a facsimile machine.

2. Description of the Related Art

A toner supply device for detachably joining a toner cartridge containing a toner to an apparatus main body to supply a toner into a toner hopper is used in an image forming apparatus such as an electrophotographic printer and copying machine, and a facsimile machine. An electrophotographic image forming apparatus draws a latent image on a photosensitive drum by a laser beam to develop the latent image with a toner. A developing container includes a toner hopper for storing and supplying the toner to be adsorbed on the surface of the photosensitive drum.

When the toner in the toner hopper is consumed by development, generally, the toner is supplied from the toner cartridge detachably joined with the image forming apparatus, into the toner hopper.

Further, when the image forming apparatus detects that the remaining amount of a developer in the toner cartridge becomes small, by a sensor or the like, the image forming apparatus displays a message to urge a user to change the toner cartridge. Furthermore, when the toner in the apparatus main body is decreased below a specified amount, the image forming apparatus stops printing. Thereafter, when the toner cartridge is changed and then the image forming apparatus can replenish the toner hopper with the toner, the image forming apparatus returns to a state in which printing can be performed.

In an image forming apparatus having a plurality of toner cartridges, when the remaining amount of respective toner cartridges becomes small, generally, a command to change the toner cartridge is issued to a user to enable individual change of the toner cartridge. Normally, it is rare that all cartridges are simultaneously changed and only one toner cartridge may be changed. However, as described above, in the apparatus with the toner cartridge which is changeable by a user operation, there has been a problem that a toner cartridge for which replacement is unnecessary is erroneously changed.

Thus, Japanese Patent Application Laid-Open No. 3-50568 discusses an apparatus for automatically changing a developing container. The apparatus selects an arbitrary developing container from a developing container containing device containing a plurality of developing containers to automatically transport it to an image forming apparatus. However, it is not preferable that a process cartridge, a developing container, and a toner cartridge are transported from an image-formable position to a detachable position to allow the toner cartridge to be changeable because it results in a large apparatus main body and an enlarged space necessary for maintenance.

Accordingly, a configuration is discussed in which a door is provided at a removal port of each of a plurality of toner cartridges, the door corresponding to the toner cartridge necessary for a change is unlocked, and the door is automatically opened, thereby notifying a user of a cartridge which needs changing. Further, U.S. Pat. No. 6,560,416 discusses a configuration in which a display device which outputs visual information is provided in each toner cartridge without providing a lock unit, thereby notifying a user of the absence of a toner.

However, in the U.S. Pat. No. 6,560,416, there are the following problems. Since the door of the toner cartridge, for which a change of the toner is necessary, is abruptly opened without confirmation by an operator, the toner cartridge may temporarily remain as it is while the door is open, which is not preferable.

Further, as discussed in U.S. Pat. No. 6,560,416, it is also conceivable that instead of automatically opening the door corresponding to the toner-absent cartridge, the display device which outputs visual information is provided without providing a lock unit, thereby notifying a toner absence state.

In this case, since the lock unit is not present, a user erroneously opens a door and image formation is stopped. Further, a plurality of displays needs to be provided, which increases manufacturing cost.

Furthermore, if a plurality of display devices is eliminated to prevent a cost increase, and in addition a lock device is provided on respective doors to prevent replacement of a toner cartridge for which a change of the toner is unnecessary, a useless operation is required such as a user searches an unlocked door.

SUMMARY OF THE INVENTION

The present invention is directed to a replenishing device capable of easily determining a cartridge that an operator needs to change without providing a display device corresponding to each cartridge, while a toner replacing door is prevented from being opened without confirmation of the operator.

According to an aspect of the present invention, a toner supply device includes a plurality of doors capable of selectively opening and closing each of a plurality of openings into which openings a plurality of cartridges each containing a respective toner can be respectively inserted; a lock mechanism to allow each of the plurality of doors to be selectively locked; a drive mechanism to automatically open an unlocked door when the door is released from a locking by the lock mechanism; a detecting unit capable of detecting information concerning the remaining amount of toner in each of the plurality of cartridges; an output unit configured to output a signal that carries information concerning the remaining amount of toner in a cartridge, among the plurality of cartridges, when that remaining amount is equal to or smaller than a predetermined amount; an input unit configured to receive an input signal for unlocking a door being locked by the lock mechanism; and a control unit configured to control the lock mechanism to selectively unlock the plurality of doors based on information detected by the detecting unit and the input signal received by the input unit.

According to another aspect of the present invention, a toner supply device includes a plurality of doors capable of selectively opening and closing each of a plurality of openings into which openings a plurality of cartridges each containing a respective toner can be respectively inserted; a lock mechanism to allow each of the plurality of doors to be selectively locked; a drive mechanism to automatically open an unlocked door when the door is released from a locking by the lock mechanism; a detecting unit capable of detecting information concerning the remaining amount of toner in each of the plurality of cartridges; an output unit configured to output a signal that carries information concerning the remaining amount of toner in at least one of the cartridges in which an amount of the toner is equal to or smaller than a predetermined amount; an input unit configured to receive and input signal for selectively unlocking at least one of the plurality of doors; and a control unit configured to control the operation of the lock mechanism to selectively unlock the plurality of doors in response to the input signal, wherein the output unit outputs at least one of a first signal that carries toner amount information only concerning the remaining amount of toner in said at least one of the cartridges, and a second signal that carries at least information concerning the remaining amount of toner in at least another of the cartridges in which the remaining amount of toner is greater than the predetermined amount, and wherein when an amount of toner in said at least one of the cartridges is equal to or smaller than a predetermined amount, the output unit outputs the first signal prior to the second signal.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6A illustrates display of the remaining amount of toners on a screen of an operation unit according to a second exemplary embodiment.

FIG. 6B illustrates a screen for confirming removal when a cartridge for which a change is unnecessary is selected.

FIG. 7A illustrates a screen on which only a toner for which a change is necessary is displayed according to a third exemplary embodiment.

FIG. 7B illustrates a screen on which only a toner for which a change is unnecessary is displayed.

DESCRIPTION OF THE EMBODIMENTS

Various exemplary embodiments, features, and aspects of the invention are described in detail below with reference to the drawings.

A dimension, the quality of a material, a shape, and a relative arrangement of a component described in an exemplary embodiment are not intended to limit a scope of this invention only to these descriptions unless otherwise particularly specified.

Figure 8:
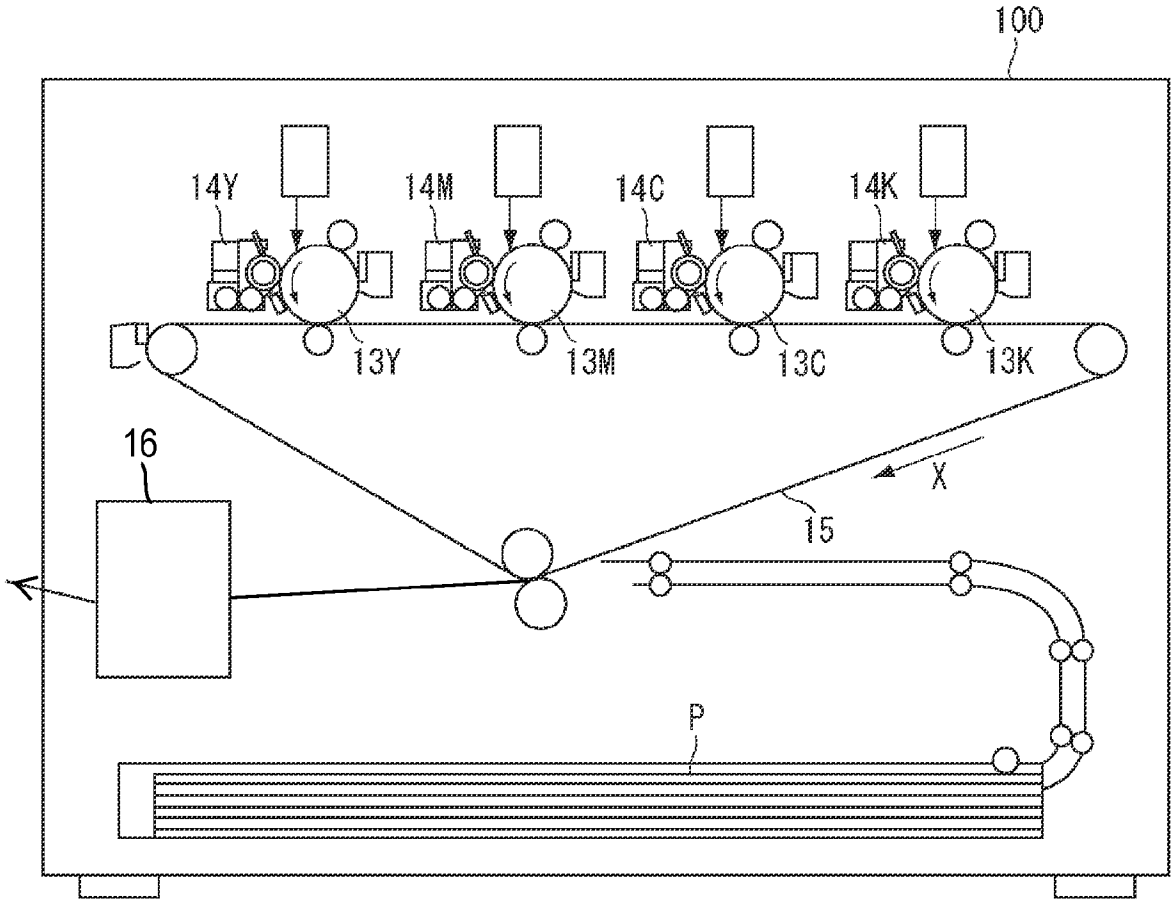
FIG. 8 is a cross sectional view illustrating an image forming apparatus.

FIG. 8 is an entire schematic diagram illustrating an image forming apparatus main body 100 (hereinafter, also referred to as "apparatus main body") according to a first exemplary embodiment. The image forming apparatus 100 according to an exemplary embodiment includes a photosensitive drum 13 (13K, 13C, 13M, and 13Y) which is an image carrier bearing an electrostatic latent image. Further, the image forming apparatus 100 includes a developing device 14 (14K, 14C, 14M, and 14Y) which is a developing unit configured to develop the electrostatic latent image on the photosensitive drum 13 to form a toner image. Furthermore, the image forming apparatus 100 includes a toner supply device 12 for supplying a toner to the developing device 14. The toner supply device 12 is described in detail below. The image forming apparatus 100 includes a transfer device 15 which is configured to transfer the toner image formed by the developing device 14 to a transfer target P. The image forming apparatus 100 includes a fixing device 16 which is configured to fix the toner image transferred to the transfer target P by the transfer device 15 to the transfer target P.

Next, the toner supply device 12 according to the present invention is described.

Figure 1B:
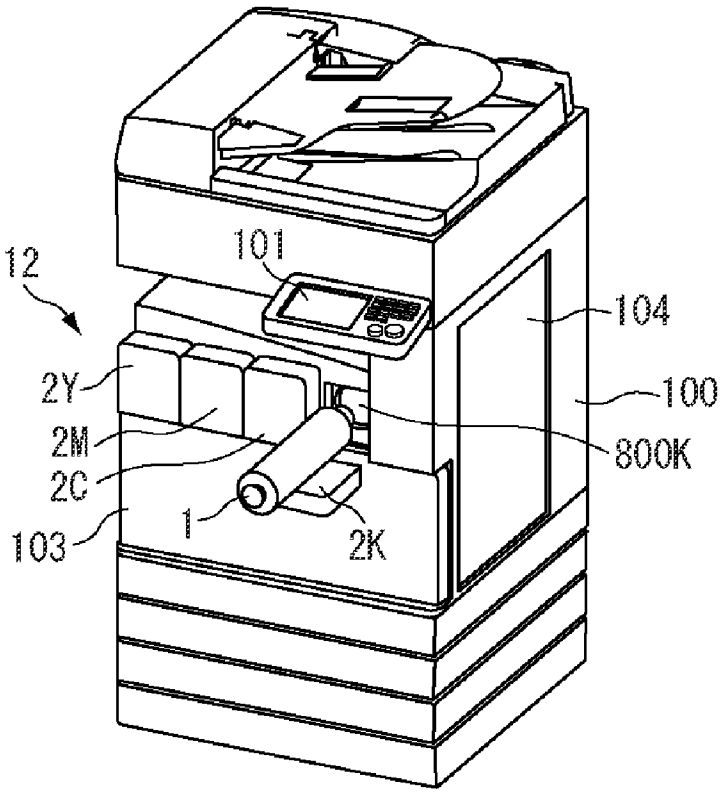
FIG. 1B is a perspective view illustrating a toner cartridge which is mounted on the image forming apparatus.
Figure 1A:
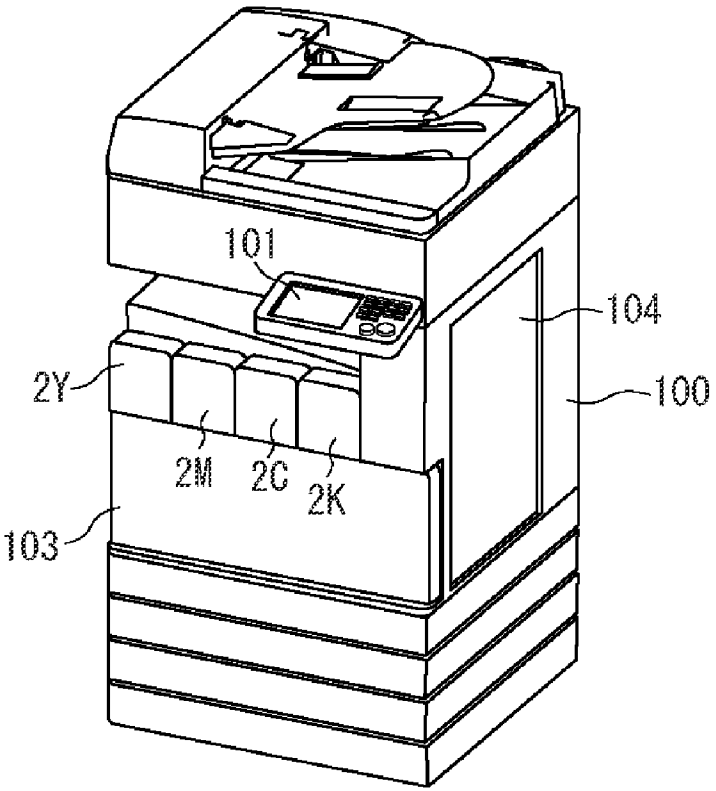
FIG. 1A is a perspective view illustrating an image forming apparatus according to an exemplary embodiment of the present invention.

FIG. 1A is a perspective view illustrating an image forming apparatus equipped with the toner supply device 12 according to the present invention. FIG. 1B is a perspective view illustrating a toner cartridge 1 containing a replenishment toner which is mounted on the image forming apparatus 100.

As illustrated in FIG. 1B, the toner supply device 12 is configured to selectively mount each of toner cartridges 1 filled with a toner to be replenished for the developing device 14, on the image forming apparatus main body 100 so that the cartridges can be freely inserted and removed. More specifically, the toner cartridge 1 can be inserted from an opening 800K, and the opening 800K can be opened and closed with a toner cartridge inserting and removing door 2K.

Next, a lock mechanism of the toner cartridge inserting and removing door 2K according to the present exemplary embodiment is described. In the present invention, toner cartridge inserting and removing doors are configured to be selectively locked.

The lock mechanism according to the present exemplary embodiment is more specifically described below.

Figure 2:
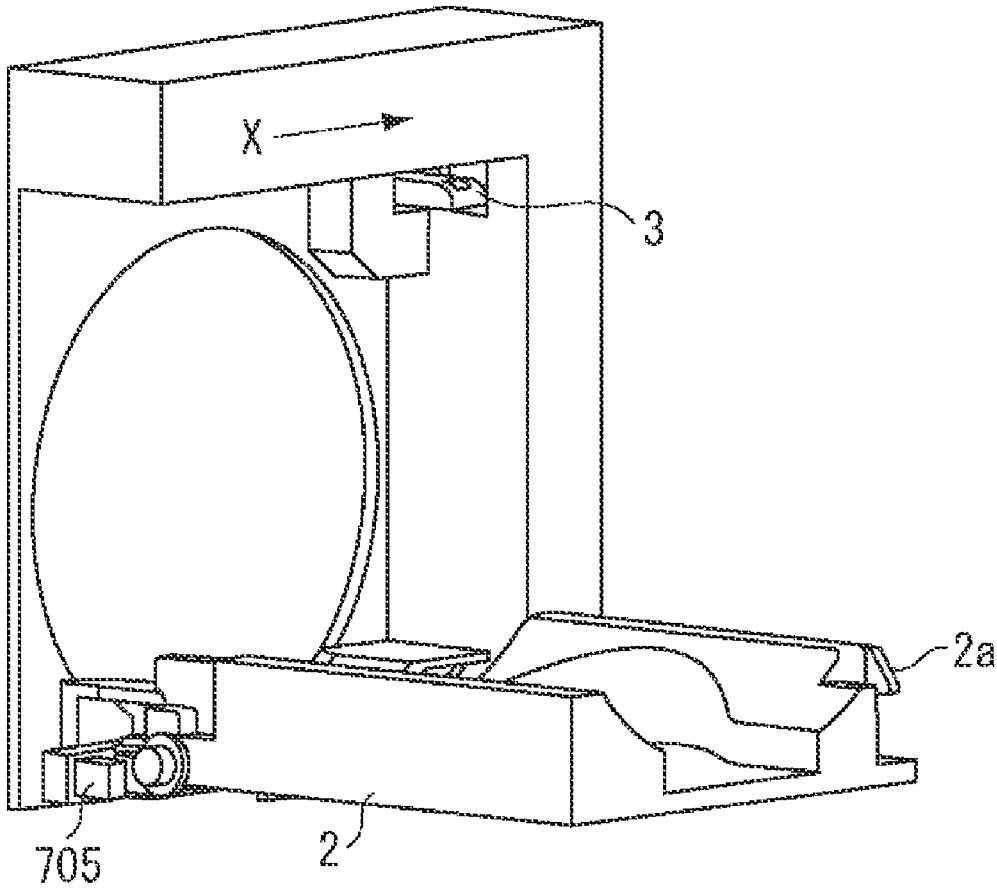
FIG. 2 is a perspective view illustrating a toner cartridge inserting and removing door.
Figure 3A:
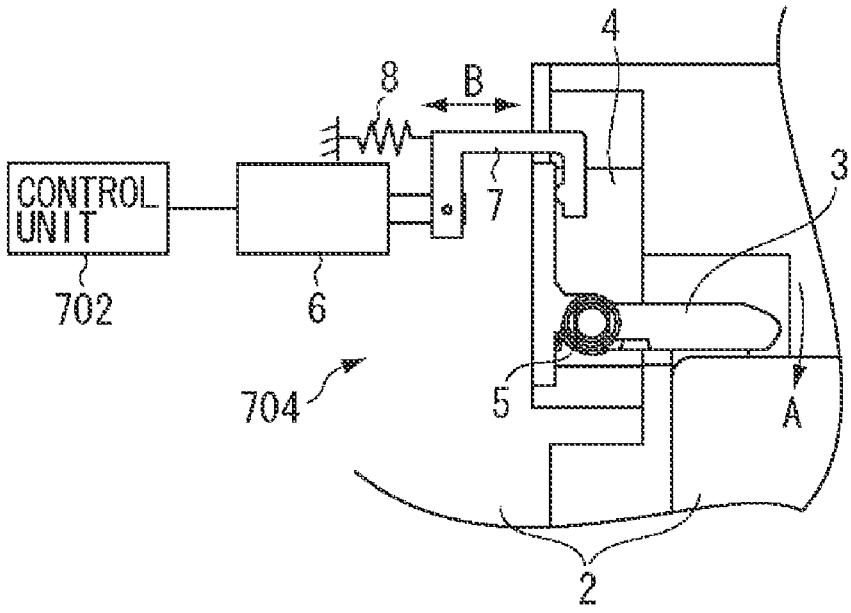
FIG. 3A illustrates a partial cross sectional view of a locking device holding a toner cartridge inserting and removing door.
Figure 3B:
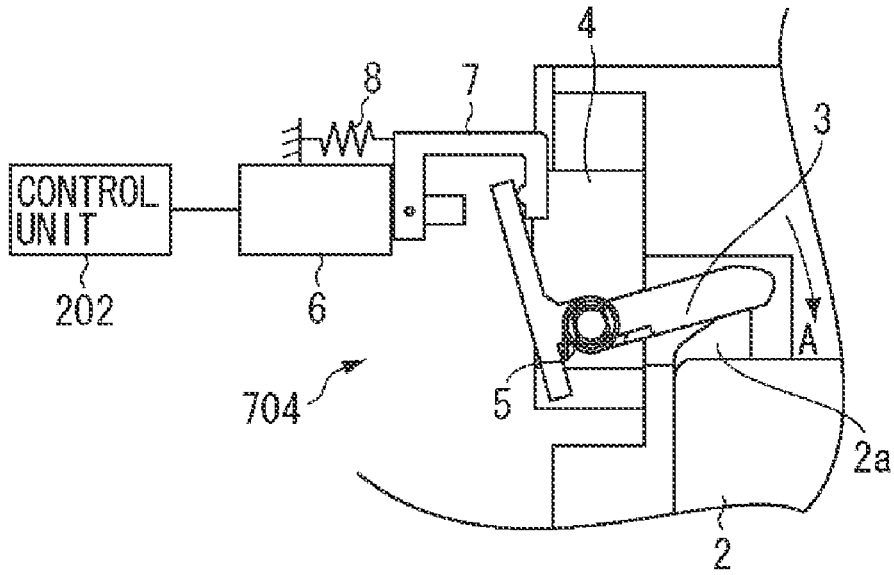
FIG. 3B illustrates a partial cross sectional view of a locking device not holding a toner cartridge inserting and removing door.

FIG. 2 illustrates a perspective view of a toner cartridge inserting and removing door 2 which is opened. FIG. 3A illustrates a partial cross sectional view of a locking device holding the door from an X direction (refer to FIG. 2) FIG. 3B illustrates a partial cross sectional view of a locking device not holding the door from an X direction with the holding device.

In FIG. 2, the toner cartridge inserting and removing door 2 are provided with a latch 3 to be engaged with a hook 2*a* and a hook 2*b*. The latch 3 is provided to be freely rotatable to a bearing member 4 (FIG. 3A) mounted on the apparatus main body 100. The latch 3 is continuously urged to rotate in the direction of arrow A by a spring 5 (FIG. 3A) and retained in a holding position illustrated in FIG. 3A. Further, the latch 3 is connected with a solenoid 6 attached to the apparatus main body. A link 7 which is slidable in the direction of arrow B is mounted on the apparatus main body. When the solenoid 6 is energized, the link 7 slides against a link returning spring 8, presses the end of the latch 3, and is rotated to an unengaged position (illustrated in FIG. 3B) against the spring 5. Thus, the latch 3 is separated from the hook 2*a*. Thus, a toner cartridge inserting and removing door 102 can be opened. The toner cartridge inserting and removing door 102 is continuously urged to rotate in an opening direction and is automatically opened when it becomes unengaged.

A unit configured to urge the toner cartridge inserting and removing door 102 to rotate (drive mechanism for driving the toner cartridge inserting and removing door 102 to automatically open when unlocked) may operate by its own weight or by an urging unit such as a spring.

The solenoid 6 has been used as a unit configured to unlock a holding device 704 of the toner cartridge inserting and removing door 2. However, a drive method of the holding device is not limited. For example, if the holding device is unlocked by a rotary drive unit, a similar effect is obtained and the present invention is applicable.

Figure 4:
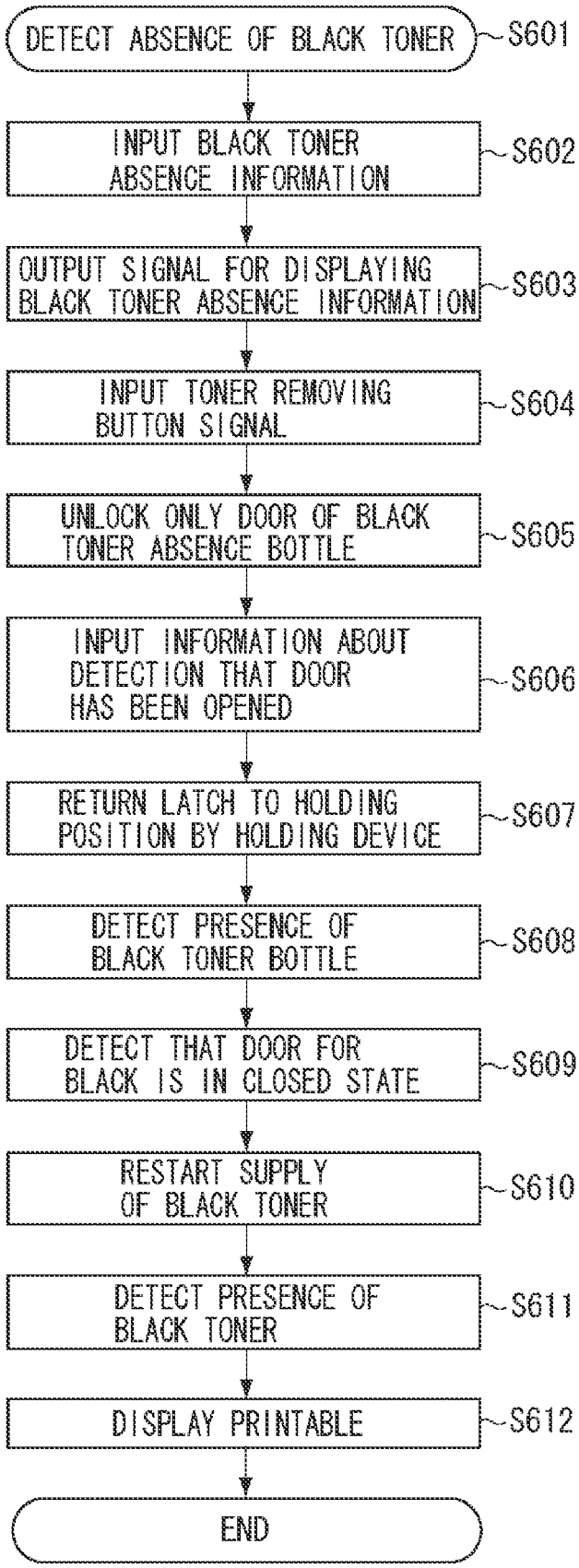
FIG. 4 is a flowchart illustrating a procedure for changing a toner cartridge.
Figure 5:
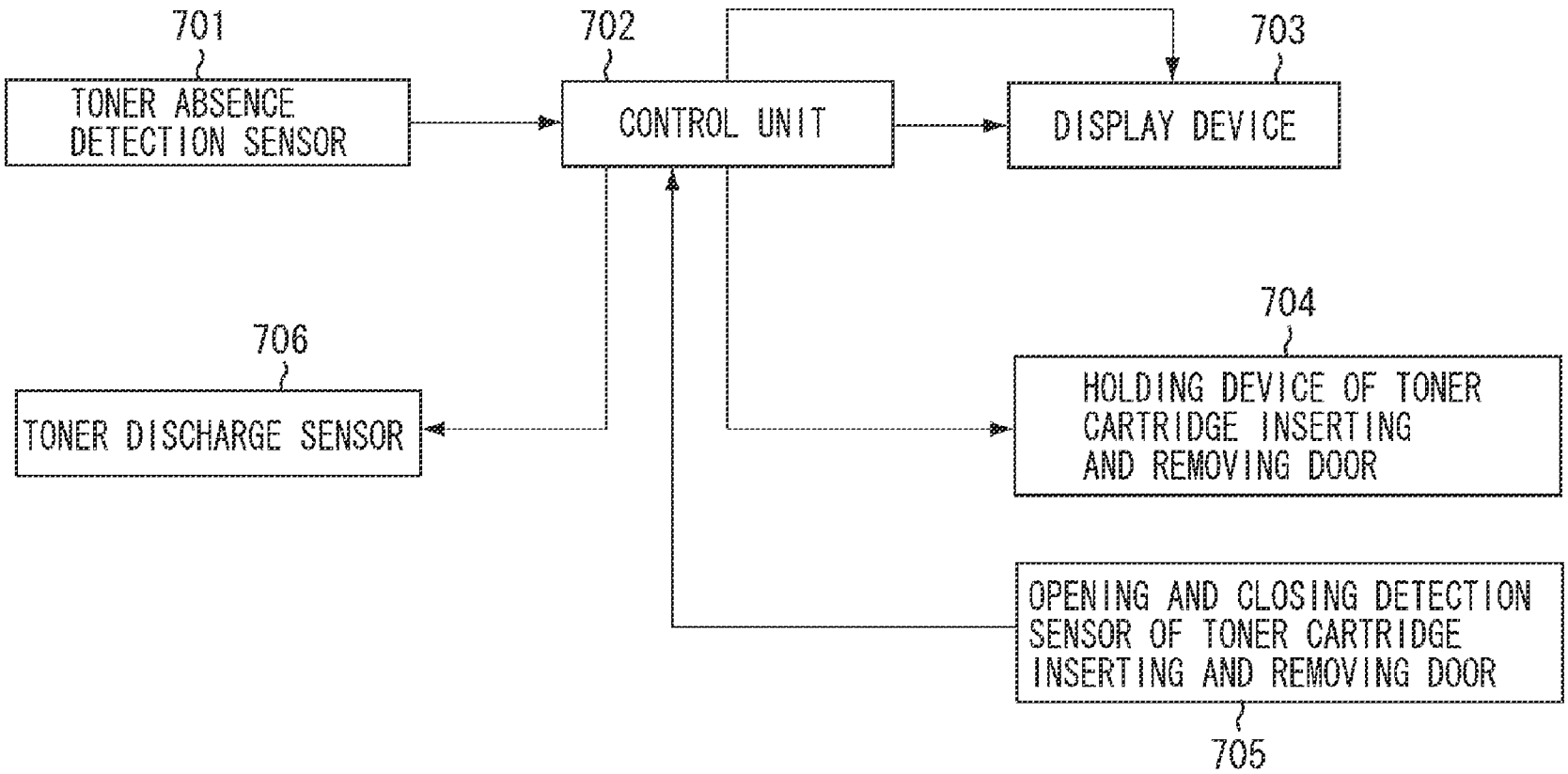
FIG. 5 is a block diagram illustrating control of a change of a toner cartridge.

Next, a procedure for changing a toner cartridge, which is a feature of the present invention, is described, in which a black toner cartridge is changed as an example according to a flowchart in FIG. 4 and a block diagram in FIG. 5. In accordance with a feature of the present invention, a toner cartridge inserting and removing door is prevented from being opened by an operation unit when an amount of a toner is equal to or larger than a predetermined amount is present in each cartridge. Only the door of a toner cartridge, which contains no toner can be unlocked from the operation unit when the absence of a toner has been detected. This prevents a user from erroneously changing a toner containing cartridge. A method for changing a toner cartridge is more specifically described below using a flowchart.

In a process of image forming, whether a toner in each toner cartridge is in a predetermined amount or smaller than that (roughly all of toner has been consumed) can be detected by a toner absence detection sensor 701 (FIG. 5) provided in each cartridge. In the present exemplary embodiment, each detection sensor constitutes a sensor unit (detecting unit), which detects toner density within each cartridge.

First, in step S5601, when the toner absence detection sensor 701 detects the absence of a toner, in step S602, toner absence information (input signal) is input to a control unit 702.

Next, in step S603, the control unit 702 outputs an output signal to display the toner absence information on a display device 703 (hereinafter, also referred to as "operation unit") such as liquid crystal display to notify a user thereof. The display unit may alternatively be connected to an external device such as a personal computer, thereby outputting the toner absence information to a display unit on the external device.

In the present exemplary embodiment, the control unit 702 functions as an output control unit configured to generate a signal for displaying information concerning the remaining amount of toners on the display device 703 serving as an output unit.

Next, the user confirms that an unlocking signal can be input from a toner removing button (in this case, operation unit) mounted on the apparatus main body 100 based on information displayed on the display device 703. In step S604, the user inputs the unlocking signal for a toner absence door from the operation unit (display device 703) serving as an input unit to the control unit 702. Then, in step S605, based on the toner absence information from the toner absence detection sensor 701, the control unit 702 outputs a signal for unlocking the holding device 704 of only the toner cartridge inserting and removing door corresponding to a toner cartridge about which the absence of a toner is detected. Thus, in response to the unlocking signal, the door can selectively be unlocked. On the other hand, the toner cartridge inserting and removing door is not unlocked which corresponds to a toner cartridge about which the presence of a toner is detected.

Then, the control unit 702 unlocks the toner cartridge 102 about which the absence of a toner is detected, based on the unlocking signal, thereby automatically opening the unlocked door as described below.

When the toner cartridge inserting and removing door 2 is opened, an opening and closing detection sensor 705 (shown in FIG. 2), which serves as a unit for detecting opening and closing of a toner cartridge inserting and removing door, detects that the toner cartridge inserting and removing door 2 has been opened. In step S606, when information about opening of the door is input from the opening and closing detection sensor 705 to the control unit 702, the control unit 702 controls the holding device 704 to de-energize the solenoid 6. Thus, in step S607, the link 7 is slid by the link return spring 8 and is separated from the end of the latch 3. The latch 3 is rotated by the spring 5, (in the direction of arrow A), and returns to a holding position.

When the toner cartridge inserting and removing door 2 is opened, the user removes the toner cartridge 1 mounted on the apparatus main body 100 and inserts a new toner cartridge. In step S608, a bottle detection sensor (not illustrated) detects that the new toner cartridge has been inserted. The toner cartridge inserting and removing door 2 is closed. Thus, in step S609, it is detected that the door is in a closed state. As the toner cartridge inserting and removing door 2 rotates, the hook 2*a* is rotated with the latch 3 located in the holding position against the action of the spring 5. Then, when the hook 2*a* reaches the holding position, the latch 3 returns to the holding position by the action of the spring 5, and the latch 3 is engaged with the hook 2*a*. Thus, the toner cartridge inserting and removing door 2 cannot be opened (FIG. 3B).

Even if the user tries to open another toner cartridge inserting and removing door which is not automatically opened, for example when a toner removing operation is performed, that door will not be opened since the door is locked. The toner cartridge inserting and removing door is not provided with a grip unit and a means for opening the door. Thus, the user is prevented from erroneously opening the door.

In step S609, when opening and closing of the toner cartridge inserting and removing door detection sensor 705 detects that the toner cartridge inserting and removing door 2 has been closed, information about closing of the door is notified to the control unit 702. Then, in step S610, the control unit 702 controls a discharge device 706 serving as a toner discharge unit to restart supply of a toner from the toner cartridge 1 to a toner hopper (not illustrated) in the apparatus main body 100. Then, in step S611, a toner is detected and toner absence notification from the toner absence detection sensor 701 to the control unit 702 is released. Then, the apparatus main body 100 returns to a printable state. In step 612, the control unit 702 displays "printable" on the operation unit 703.

In the configuration described above, when a toner remains in a toner cartridge and a change thereof is not required, the toner cartridge inserting and removing door is held to reject opening and closing thereof. Further, when the remaining amount of toners in a toner cartridge decreases and its replacement is needed, only the door corresponding to the toner cartridge can be opened and closed. Thus, inconvenience and cost, such as the user erroneously changes a toner cartridge unnecessary for the replacement, can be prevented from occurring.

In the present exemplary embodiment, the toner removing button is displayed on the operation unit, and the user can press the button to open the door of a toner absence cartridge, but the present invention it is not limited to this configuration. For example, the unlocking button of each cartridge can be provided to validate only an operation of the unlocking button corresponding to the toner absence cartridge when the absence of toners has been detected.

According to the present exemplary embodiment of the present invention, the toner cartridge inserting and removing door 2 is provided separate from a jam processing door 103 and a door for maintaining an imaging unit 104. Thus, it is not necessary that a printing operation of the apparatus main body 100 is stopped by opening these doors. Accordingly, even when the apparatus main body 100 detects the absence of toners for a toner cartridge other than black, and the user performs a toner removing operation and changes the toner cartridge, image formation and printing thereof can be performed by a black toner. Further, a large capacity toner hopper (not illustrated) may be installed in the apparatus main body to enable storage of a toner necessary for image formation. Thus, even when the toner cartridge inserting and removing door 2 is opened and a toner cartridge is changed, the apparatus main body 100 can retain a printable state. In a case where the large capacity toner hopper is installed, if roughly all toners in the toner hopper have been consumed as well as a toner in a toner cartridge, the apparatus main body 100 stops printing.

Further, in process of a change of a toner according to the above-described procedure, a toner about which the absence is detected is displayed on the operation unit and the toner cartridge inserting and removing door corresponding thereto is opened by the toner removing operation. However, when the absence of toners has been detected about a plurality of toner cartridges, these cartridges are not necessarily simultaneously changed. It is desirable that a color to be changed can be selected. It is particularly effective when the large capacity toner hopper is installed and an image forming apparatus can continue constant image forming after the absence of a toner in a toner cartridge has been detected. Furthermore, when a color toner and a black toner are simultaneously absent in toners, if only the black toner cartridge is changed, printing can continue in a monochrome mode.

In the first exemplary embodiment, a user operates the toner removing button mounted on the apparatus main body, thereby unlocking only the holding device of the toner cartridge inserting and removing door corresponding to the toner cartridge about which the absence of toners is detected. However, some users may wish to change a toner cartridge when the absence of toners is not detected. Thus, in a second exemplary embodiment, a user can select also a toner presence cartridge other than the toner absence cartridge.

A display of the absence of toners and an exemplary embodiment of a toner removing unit on a suitable operation unit are described below. To avoid redundant description, only that portion of the present exemplary embodiment which is different from the first exemplary embodiment is described below.

When the remaining amount of toners is displayed on a screen on an operation unit 101 illustrated in FIG. 6A, a state of the remaining amount and a need for a change of all toners are displayed. A user selects a color (on which a removing operation is performed) on this screen and presses a removing button 101*a* on the same screen. Thus, the apparatus main body 100 unlocks holding of the toner cartridge inserting and removing door 2 corresponding to the selected color and open the door. The toner removing button can select a toner cartridge to be changed after the absence of toners has been detected while confirming the cartridge on the operation unit 101. Accordingly, removal of a toner of an erroneous color can be avoided. Further, in this way, even when this screen is shared with a screen for confirming the remaining amount of toners in a normal operation of the apparatus main body 100, an erroneous toner can be prevented from being removed.

Furthermore, in the present exemplary embodiment, a user does not erroneously change a toner presence cartridge as described below. When the remaining amount of toners is displayed on the screen in the operation unit 101, the remaining amount and a need for a change of all toners are displayed. At this time, when a user inputs an unlocking signal of the door of a toner absence cartridge, the door is immediately unlocked and the door is automatically opened.

On the other hand, when a user inputs an unlocking signal of the door of a toner cartridge which does not require a change, the door is not immediately opened. After the removing button is pressed, a confirmation screen in FIG. 6B is displayed. The control unit 702 unlocks the door in response to a signal of acceptance or rejection of unlocking which is input from the operation unit. In other words, the door is opened only when confirmation has been obtained from a user through the confirmation screen. Thus, a wrong toner is prevented from being removed and intentional removal of a toner cartridge in which a toner still remains can be permitted.

Figure 9:
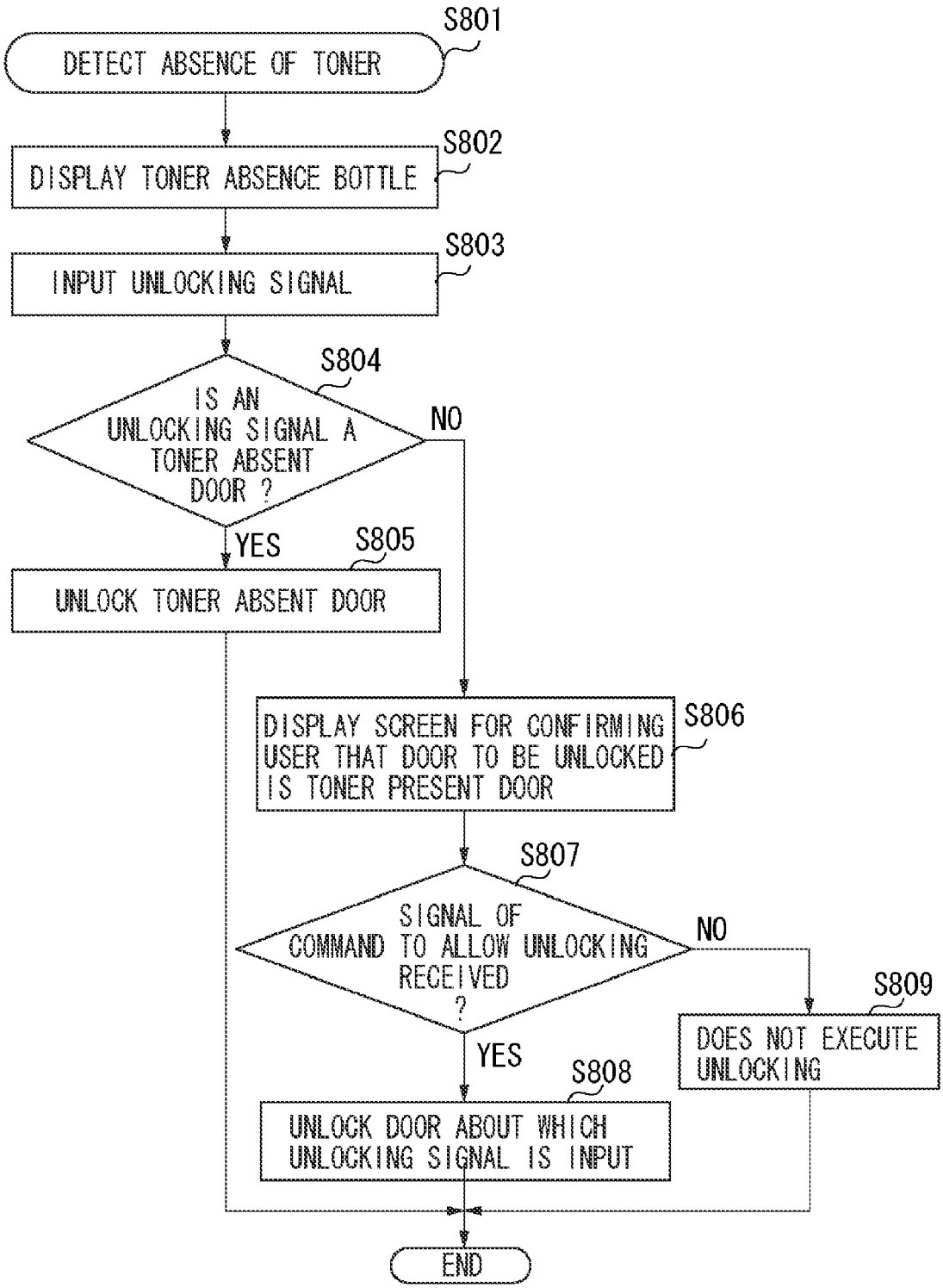
FIG. 9 is a flowchart illustrating control of an unlocking operation according to a second exemplary embodiment.

An unlocking operation in the present exemplary embodiment will specifically be described below using a flowchart in FIG. 9.

In step S801, when a sensor detects the absence of a toner, in step S802, a central processing unit (CPU) displays a toner absence bottle. Next, in step S803, when the CPU receives an unlocking signal input from an operation unit, in step S804, the CPU determines whether a door to be unlocked is a toner absence door. Then, when an unlocking signal is the signal of the door about which the absence of a toner is detected (YES in step S804), in step S805, the CPU immediately unlocks the toner absence door. On the other hand, when an unlocking signal is not the signal of the door about which the absence of a toner is detected (NO in step S804), in step S806, the CPU does not immediately unlock the door but does display a screen for confirming acceptance or rejection of unlocking on a display unit (operation unit). If the signal of acceptance or rejection of unlocking is input from the operation unit after step S806, in step S807, the CPU determines whether a signal of a command to allow unlocking has been input. Then, when the CPU receives the signal (signal which allows unlocking) that a door to be unlocked may be a toner presence door (YES in step S807), in step S808, the CPU unlocks a door to which the unlocking signal has been input. On the other hand, when the CPU does not receive the signal of a command that a door to be unlocked may be a toner presence door (NO in step S807), in step S809, the CPU does not execute unlocking.

In the second exemplary embodiment, the remaining amount and a need for a change of all toners are displayed, and a color to be changed is selected according to determination by a user.

A feature in a third exemplary embodiment is configured to allow switching of a display of a toner about which a change is necessary and a display of a toner about which a change is unnecessary. In addition, a toner cartridge about which a change is necessary is preferentially displayed, so that an error in determination and operation by a user can be further suppressed.

A display of the state of a toner and an exemplary embodiment of a toner removing unit on a suitable operation unit are described below. To avoid redundant description, only that portion of the present exemplary embodiment which is different from the first and the second exemplary embodiments is described below.

In the present exemplary embodiment, the remaining amount of toners in a toner cartridge about which a change is necessary and the remaining amount of toners in a toner cartridge about which a change is unnecessary can be switched by a pull-down button 101*b*, and displayed on the screen in the operation unit 101 (refer to FIGS. 7A and 7B). In the present exemplary embodiment, the toner cartridge about which a change is necessary refers to a toner cartridge in which the remaining amount is equal to or smaller than the predetermined amount. The toner cartridge about which a change is unnecessary refers to a cartridge other than the toner cartridge in which the remaining amount is equal to or smaller than the predetermined amount.

When toner absence information is input from the toner absence detection sensor 701 within a toner bottle mounted on the apparatus main body 100 to the control unit 702, the control unit 702 first displays a list of a toner, about which a change is necessary, on the screen in the operation unit 101. The control unit 702 as an output control unit generates a signal (first signal) for displaying the list of a toner, about which a change is necessary, on the screen in the operation unit 101, and a list displaying only a toner about which a change is necessary can be output to the operation unit (FIG. 7A). Then, when a user inputs a signal for switching a screen with the pull-down button 101*b*, the control unit 702 performs control to output to the operation unit (FIG. 7B) a list displaying at least a toner about which a change is unnecessary. The control unit 702 generates a signal (second signal) for displaying a list of a toner about which a change is necessary. According to this configuration, normally, a user can select removal of only a cartridge about which a change is necessary without being conscious of a toner color to be changed. Further, as needed, a display is switched and a toner cartridge about which a change is unnecessary is selectable. Thus, intentional removal of a toner cartridge in which a toner still remains can be permitted. Also in this case, an erroneous toner is effectively prevented from being removed by a confirmation screen illustrated in FIG. 6B.

As a display unit of the state of a toner or the like, and a unit configured to execute an operation such as selection of a toner, the operation unit 101 mounted on the apparatus main body 100 has been described above as an example but the present is not limited to this type of configuration. For example, a similar effect is obtained when a monitor of an external PC is used as an output unit and the external PC is used as an input unit, to which the present invention is applicable.

One image forming apparatus may selectively execute each configuration in the first to the third exemplary embodiments. In other words, the first to the third exemplary embodiments may also be selectively executed from the operation unit as respective modes. Thus, a mode of preventing a toner cartridge from being removed in the middle in any circumstance as in the first exemplary embodiment, and a mode of permitting a toner cartridge to be removed in the middle only when the absence of a toner has been detected as in the second exemplary embodiment can selectively be executed.

Further, other than the above-described modes, even if the absence of a toner is not detected, a mode of allowing a toner cartridge to be removed in the middle from the operation unit is also feasible. In this case, a service man or the like can perform such a setting from the operation unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-105357 filed Apr. 23, 2009, which is hereby incorporated by reference herein in its entirety.

What is claimed is:

1. An image forming apparatus comprising:

a plurality of doors capable of selectively opening and closing each of a plurality of openings into which a plurality of cartridges each containing a respective toner can be respectively inserted;

a lock mechanism to allow each of the plurality of doors to be selectively locked;

a drive mechanism to automatically open an unlocked door when the door is released from a locking by the lock mechanism;

a detecting unit capable of detecting information concerning the remaining amount of toner in each of the plurality of cartridges;

an output unit configured to output a signal that carries information concerning the remaining amount of toner in a cartridge, among the plurality of cartridges, when that remaining amount is equal to or smaller than a predetermined amount;

an input unit configured to receive an input signal for unlocking a door being locked by the lock mechanism; and a control unit configured to control the lock mechanism to selectively unlock the plurality of doors based on information detected by the detecting unit and the input signal received by the input unit, wherein, in a case where an input signal input in the input unit by a user is a signal for unlocking a locking of a door corresponding to the cartridge in which the remaining amount of the toner is equal to or smaller than the predetermined amount, the control unit controls the lock mechanism to immediately unlock the locking of the door corresponding to the input signal input in the input unit while, in a case where an input signal input in the input unit by the user is not a signal for unlocking a locking of a door corresponding to the cartridge in which the remaining amount of the toner is equal to or smaller than the predetermined amount, the control unit outputs information for confirming that the input signal input in the input unit is not the signal for unlocking the locking of the door corresponding to the cartridge in which the remaining amount of the toner is equal to or smaller than the predetermined amount and controls the lock mechanism to unlock or not to unlock the door in response to a signal input in the input unit by the user, based on whether the input signal is a signal of acceptance of unlocking or a signal of rejection of unlocking.

2. The image forming apparatus according to claim 1, wherein the control unit controls the lock mechanism to unlock only the door of a cartridge in which an amount of the toner is equal to or smaller than the predetermined amount based on the unlocking signal received by the input unit.

3. The image forming apparatus according to claim 1, wherein the output unit can output a first signal for displaying information concerning the remaining amount of toner only in a toner cartridge in which an amount of the toner is equal to or smaller than the predetermined amount, and a second signal for displaying at least information concerning the remaining amount of toner in a cartridge other than the cartridge in which an amount of the toner is equal to or smaller than the predetermined amount respectively, wherein when an amount of a toner in the former cartridge is equal to or smaller than a predetermined amount, the first signal is output prior to the second signal.

4. The image forming apparatus according to claim 1, further comprising a display unit configured to display information concerning the remaining amount of toner in the plurality of cartridges based on an output signal from the output unit.

5. The image forming apparatus according to claim 4, wherein only information concerning the remaining amount of toner of the door of a cartridge in which an amount of the toner is equal to or smaller than the predetermined amount is displayed on the display unit.

* * * * *